US005775624A

United States Patent [19]

Huerta

[11] Patent Number: 5,775,624

[45] Date of Patent: Jul. 7, 1998

[54] ROLL HOLDER WITH LOCKING PAPER ROLL TENSIONING MEMBER

[76] Inventor: Joe A. Huerta, 12634 S. 35th Pl., Phoenix, Ariz. 85044

[21] Appl. No.: 673,731

[22] Filed: Jun. 26, 1996

[51] Int. Cl.[6] ..... B65H 23/06; B65D 85/02; E04D 15/00

[52] U.S. Cl. ..... 242/422.6; 242/588.2; 156/577

[58] Field of Search ..... 242/422.5, 422.6, 242/588.2; 156/577

[56] References Cited

U.S. PATENT DOCUMENTS

| | | | |
|---|---|---|---|
| 1,829,719 | 10/1931 | Horton | 242/422.6 |
| 1,981,590 | 11/1934 | Easterling | 242/422.6 |
| 2,346,756 | 4/1944 | Hoppe | 242/422.5 |
| 2,453,476 | 11/1948 | Troidl | 242/422.6 |
| 3,471,097 | 10/1969 | Phelps | 242/422.6 |
| 3,603,494 | 9/1971 | Ulmer | 242/422.6 |
| 4,096,021 | 6/1978 | Pool et al. | 156/527 |
| 4,379,019 | 4/1983 | Pool | 156/527 |
| 4,448,363 | 5/1984 | Mukenschnabl | 242/422.6 |
| 4,667,891 | 5/1987 | Pool | 242/75.4 |
| 4,783,016 | 11/1988 | Pool | 242/55.2 |
| 5,381,942 | 1/1995 | Lin | 156/577 |
| 5,456,790 | 10/1995 | Yu Chen | 156/577 |
| 5,467,935 | 11/1995 | Moody | 242/422.5 |

FOREIGN PATENT DOCUMENTS

| | | | |
|---|---|---|---|
| 0994739 | 11/1951 | France | 242/422.5 |
| 1919501 | 12/1970 | Germany | 156/577 |
| 0568096 | 10/1957 | Italy | 242/422.5 |
| 0471943 | 9/1937 | United Kingdom | 242/422.5 |
| 2144102 | 2/1985 | United Kingdom | 242/422.5 |

*Primary Examiner*—Daniel P. Stodola
*Assistant Examiner*—Matthew A. Kaness
*Attorney, Agent, or Firm*—Parsons & Goltry; Robert A. Parsons; Michael W. Goltry

[57] ABSTRACT

A hand held masking machine (10) for dispensing paper and tape, including a frame (41) having a handle (65) for being held by a human hand, a paper tensioning member (80, 100) movable between a normal first orientation for applying tension to a roll (60) of paper, and a second orientation for releasing tension from the roll (60) of paper, and a detent (91) engagable by the tensioning member (80, 100) for holding the tensioning member (80, 100) in the second orientation.

2 Claims, 1 Drawing Sheet

FIG. 1
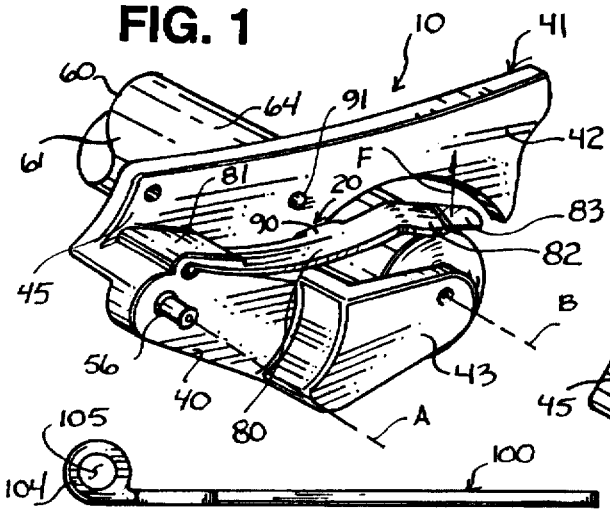
FIG. 2
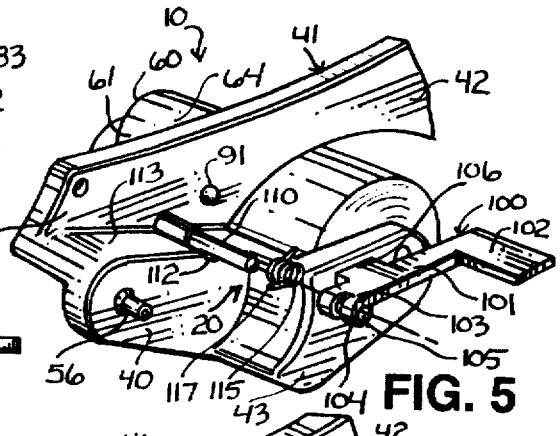
FIG. 3
FIG. 4
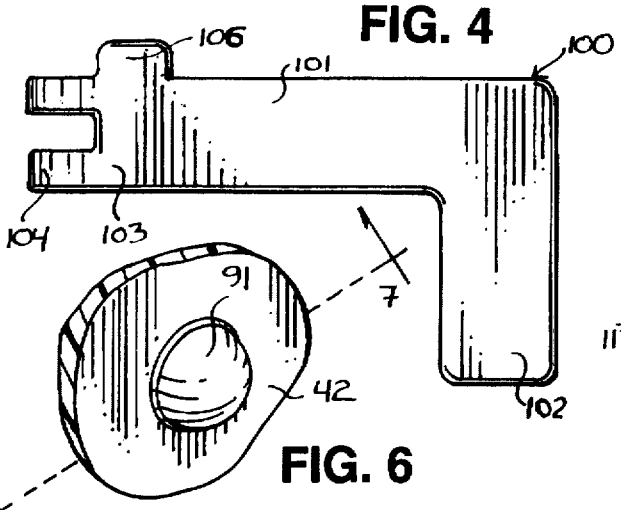
FIG. 5
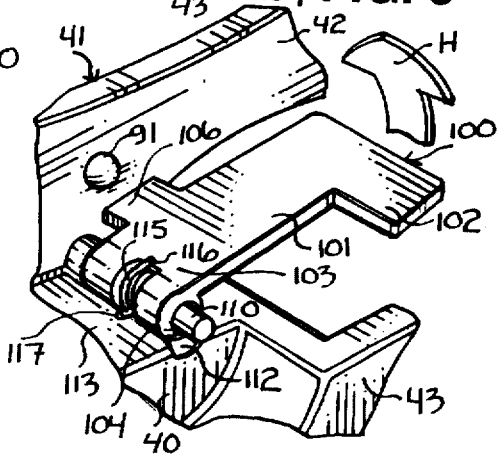
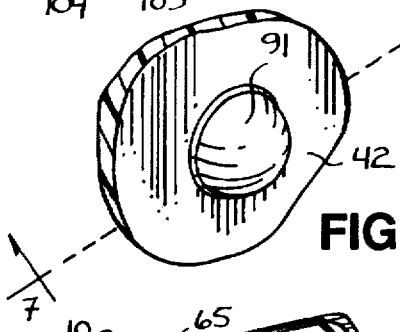
FIG. 6
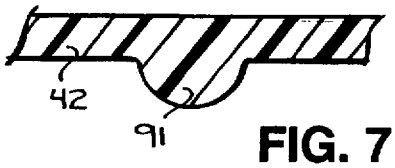
FIG. 7
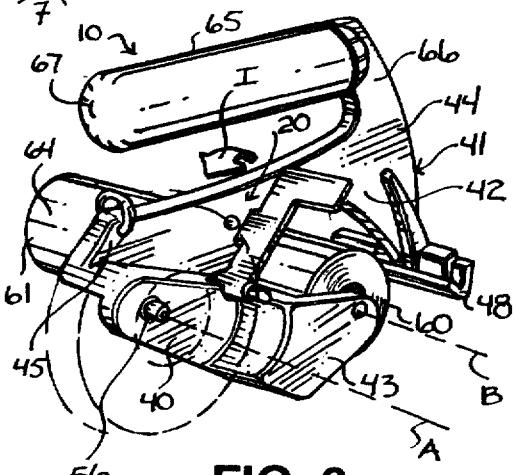
FIG. 8
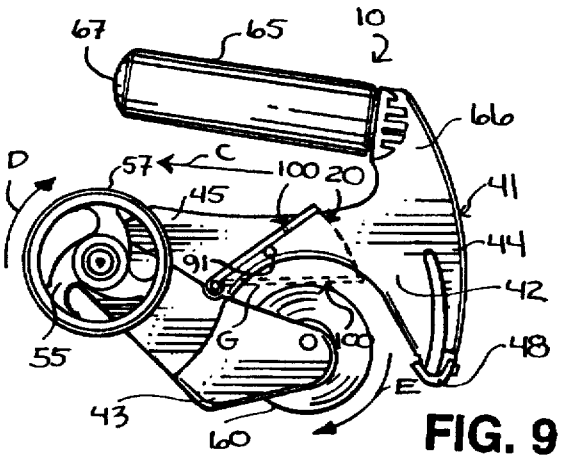
FIG. 9

ROLL HOLDER WITH LOCKING PAPER ROLL TENSIONING MEMBER

TECHNICAL FIELD

This invention relates to masking machines.

More particularly, the instant invention relates to masking machines such as the hand-held type used for applying tape and paper to a surface prepatory to applying a finish to the surface.

In a further and more specific aspect, the present invention relates to improvements to enhance the utility of masking machines.

BACKGROUND ART

The prior art is replete with various devices for applying tape and paper to a surface in preparation for painting, trimming and other finishing techniques. In general, such devices, which have achieved broad acceptance by both industrial and non-commercial users alike, are employed for protecting a designated portion of a surface from a finish or treatment applied to an adjacent portion of the surface. Exemplary is the general painting and decorative trimming of vehicle bodies, walls of buildings and other large and small items in connection with vocational and avocational pursuits.

Generally referred to as masking machines, the devices are available in a variety of sizes and configurations especially adapted for various uses. While having similar function, specifically the dispensing of tape and paper, and having commonly analogous components including a holder for a roll of tape, a holder for a roll of paper and a cutting edge for severing the tape and the paper, the various masking machines present exceedingly dissimilar appearances. The apron machine, for example, is usually a large, bulky, floor-supported apparatus. The hand held machine, on the other hand, is a relatively lightweight and compact unit.

Exemplary of prior art masking machines, and herein chosen for purposes of orientation in connection with the instant invention, is the hand held device which includes a handled frame having a rotatably affixed paper roll holder and a rotatably affixed tape roll holder for supporting a roll of coiled paper sheet and a roll of coiled, pressure sensitive tape, respectively. The holders, which have parallel axes of rotation, are oriented such that the tape is dispensed along and overlapping an edge of the paper sheet. As the machine is moved along, the paper and the tape are drawn therefrom and the free portion of the tape is adhesively secured to the surface by the wiping action of the curved portion of a guide bar. When the end of the areas to be masked has been reached, the tape and paper are severed by an elongate cutting edge extending from the frame parallel to the axis of rotation of the holders.

The masking machine, as described above, has proven to satisfactorily achieve the objects for which it was devised. This is attested, in part, by commercial success. Observation, however, has indicated areas of interest and concern not before considered in connection ith the instant machine or analogous devices.

For example, users frequently carry an additional roll of tape for periodic or continuous taping along the free edge of the paper sheet. Also, it is noted that the paper tension spring which insures even movement of the roll of paper and prevents inadvertent unrolling requires independent manual manipulation as the paper roll is installed upon the paper roll holder.

In view of the foregoing and other observations, experimentation has been conducted for the purpose of improving the referenced masking machine and other similar devices.

DISCLOSURE OF THE INVENTION

It would be highly advantageous, therefore, to remedy the foregoing and other deficiencies inherent in the prior art.

Accordingly, it is an object of the instant invention to provide improvements for masking machines.

Another object of the invention is the provision of improvements which will enhance the function of the machine and facilitate convenience of the operator.

Still another object of the invention is to provide improved means which will reduce manual manipulation while affixing a roll of paper.

And still another object of the invention is the provision of presenting a conveniently available roll of tape for selective use by the operator.

And a further object of the present invention is the provision of improved paper tensioning means.

Still a further object of the invention is to provide means which facilitate the rapid and convenient exchange of rolls upon the roll holders.

Yet still a further object of the invention is the provision of improvements, as above, which are usable upon hand held and other masking machines.

Briefly, to achieve the desired objects of the present invention in accordance with a preferred embodiment thereof, provided are checking means usable in combination with the respective roll holders for checking the uncoiling of the paper sheet. The checking means includes a tensioning member having a fixed end pivotally connected to the frame of the machine, and terminating with a free end. Biasing means carried at the fixed end of the tensioning member, urges the free end toward the holder in a first orientation for bearing against the outer surface of the roll of paper. Also carried at the free end is a lifting portion, accessible by a finger of a hand while the hand is gripping the elongate handle, for releasing the free end in a second orientation from the outer surface of the roll of paper. Further provided is a detent means for holding the retention member in the second orientation, the detent means comprising a detent detachably engagable by the retention member.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which:

FIG. 1 is a fragmentary perspective view of a hand held masking machine illustrating an improved paper tensioning means and detent means;

FIG. 2 is a fragmentary perspective view of the hand held masking machine very similar to that seen in FIG. 1 and further illustrating an exploded perspective view of an alternate embodiment of the improved paper tensioning means;

FIG. 3 is an enlarged side elevational view of a paper tensioning member illustrated in combination with the improved paper tensioning of FIG. 2;

FIG. 4 is a top plan view of the paper tensioning member hown in FIG. 3;

FIG. 5 is a fragmentary perspective view of the hand held masking machine of FIG. 1, further illustrating the improved paper tensioning means of FIG. 2 as it would appear in operation in relation to the detent means;

FIG. 6 is an enlarged perspective view of the detent means first illustrated in combination with FIG. 1;

FIG. 7 is a sectional view taken along line 7—7 of FIG. 6;

FIG. 8 is a perspective view of the hand held masking machine of FIG. 1, and further illustrating a roll of paper carried thereon in cooperation with the improved paper tensioning means of FIG. 2; and FIG. 9 is a side elevational view of the hand held masking machine shown in FIG. 8, further illustrating the range of movement of the paper tensioning member between a first orientation and a second orientation.

BEST MODES FOR CARRYING OUT THE INVENTION

Turning now to the drawings in which like reference characters indicate corresponding elements throughout the several views, attention is first directed to FIG. 1 which illustrates a hand held masking machine generally designated by the reference character 10 incorporating an improved paper tensioning means being generally designated by the reference character 20. For the purpose of orientation, the general structural details of hand held masking machine 10 will now be discussed to the extent necessary to facilitate discussion of paper tensioning means 20, and to further enable those having ordinary skill to make and practice the same.

With continuing reference to FIG. 1, and additional reference to FIG. 8, hand held masking machine 10 includes, in relevant part, a frame 41 having substantially flat section 42 and primary offset section 43. For purposes of orientation, it is considered that frame 41 includes a forward portion 44 and a rearward portion 45. At the forward portion 44, frame 41 is provided with a transverse elongate mounting bracket 48.

Frame 41, including each of the foregoing named elements, is integrally formed of plastic in accordance with conventional injection molding techniques.

Tape roll holder 55, shown in FIG. 9, is rotatably mounted upon a spindle 56 which extends outwardly from secondary offset section 40 of frame 41. Holder 55 is retained upon spindle 56 by means of a washer (not herein specifically shown) and a screw (not herein specifically shown) which is threaded into spindle 56. Holder 55 rotates about axis A which is generally parallel to mounting bracket 48. A roll 57 (FIG. 9) of coiled, pressure-sensitive tape is detachably carried by tape roll holder 55.

A roll 60 of coiled paper sheet 61 having an outer surface 64 is held by a paper roll holder (not shown) rotatably carried by offset section 43. The paper roll holder is rotatable about axis B which is parallel to axis A.

As can be seen in FIG. 8, elongate handle 65 extends from an upwardly extending portion 66 and terminates with a free end 67. Upwardly extending portion 66 is integral with frame 41 proximate forward portion 44, and extends upwardly from frame 41. During operation, a human hand (not shown) holds handle 65 and moves the masking machine in the direction of arrowed line C shown in FIG. 9. Accordingly, as sheet 61 is dispensed and remains stationary, roll 56 and paper roll 60 rotate in the direction of arrowed lines D and E, respectively (FIG. 9). Paper roll 60 is offset relative tape roll 56 such that a portion of the tape overlaps an end of the paper, leaving another portion of the tape available for continuous adhesion to the surface to be masked.

Referring back to FIG. 1, there is seen the improved paper tension means 20 for applying tension to the outer surface of the paper roll, checking uncoiling of the paper sheet, and having a lifting portion integral with the paper tensioning means for easily releasing the tension on the paper roll. In particular, paper tensioning means 20 includes a flexible tensioning member 80 fixed to and extending forwardly from a bracket 81 formed upon secondary offset section 40 proximate rearward portion 45 of frame 41, tensioning member 80 further terminating with a free end 82 having a lifting portion 83. Tensioning member 80 is biased in a first normal orientation (FIG. 1) for urging free end 82 against outer surface 64 of paper roll 60 retained on masking machine 10.

During operation, free end 82 bears against outer surface 64 of paper roll 60 for maintaining tension upon outer surface 64 to ensure even movement of roll 60 during the dispensing of paper sheet 61, and to engage tape 57 onto an edge of paper sheet 61 so as to ensure adhesion of the tape thereto (not herein specifically shown). Lifting portion 83 is accessible for displacing tensioning member 80 into a second configuration for releasing the tension applied to paper roll 60, lifting portion 83 being accessible by a finger of the hand while the grip is being maintained (not herein specifically shown) for lifting the tensioning member 80 away from outer surface 64 of roll 60 in the direction of arrowed line F. As a result of the proximation of the lifting portion in relation to handle 65, the paper tensioning member 80 may be released from the outer surface 64 of roll 60 during use thereof. Additionally, a user can also lift the lifting portion out of the way for inserting a roll of paper upon masking machine 10.

To hold or lock tensioning member 80 in the second orientation, provided is a tab 90 carried by tensioning member 80 which is detachably engagable with a detent 91 formed on flat section 42. In order to engage tab 90 with detent 91, tensioning member 80 need only be urged in the direction indicated by arrowed line F causing tab 90 to snap over detent 91 thereby engaging tab 90 with detent 91 until disengaged by reversing this operation. It will be readily understood by those having ordinary skill that other means may be employed for retaining tensioning member 80 in the second orientation without departing from the nature and scope of the instant invention as herein specifically described. Furthermore, although detent 91 may be of any desired configuration, FIG. 6 shows detent 91 having a substantially convex shape, which can further be seen in FIG. 7 which illustrates a sectional view of detent 91 taken along line 7—7 of FIG. 6.

An alternate embodiment of the improved paper tensioning means 20 is illustrated in FIGS. 2-5, which is seen a substantially rigid tensioning member 100 having an arm 101 with a handle 102. Arm 101 includes an inward end 103 having a bifurcated bracket 104 with a bore 105 extending therethrough, and a tab 106 extending inwardly proximate inward end 103. As shown in FIGS. 2 and 5, tensioning member 100 is pivotally mounted to frame 41. In particular, bore 105 of bifurcated bracket 104 is pivotally received upon a transverse support member 110 extending from substantially flat section 42, transverse support member 110 being somewhat suspended within a transverse recess 112 formed in upper surface 113 of secondary offset section 40. A conventional torsion spring 115 having ends 116 and 117 is also carried on support member 110 within bifurcated bracket 104. Torsion spring 115 is operative for biasing tensioning member 100 in the first orientation, as indicated by dashed outline G of tensioning member 100 shown in FIG. 9. Similar to the improved paper tensioning means described in connection with FIG. 1, tensioning member 100 functions as a bearing element, and in response to torsion spring 115, maintains tension upon outer surface 64 of roll 60 ensuring even movement of roll 60 during the dispensing of paper sheet 61.

Handle 102 is a lifting portion operative for allowing a user to displace tensioning member 80 into the second configuration (FIG. 9) for releasing the tension applied to paper roll 60, handle 102 being accessible by a finger of a hand while the grip is being maintained for lifting tensioning member 100 away from outer surface 64 of roll 60 in the direction indicated by arrow H in FIG. 5 and arrow I in FIG. 8. Additionally, like the previously described embodiment, a user can also lift tensioning member 100 out of the way for inserting a roll of paper upon masking machine 10. Furthermore, to hold or lock tensioning member 100 in the second orientation, tab 106 may be engaged with detent 91 as previously described in combination with FIG. 1 to hold tensioning member in the second orientation, which can easily be seen in FIG. 9.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. In a hand held masking machine for dispensing paper and tape, said hand held masking machine including:

a frame having a handle carried thereby for being held by a human hand;

a paper tensioning member carried by said frame and movable between a normal first orientation for applying tension to a roll of paper, and a second orientation for releasing tension from said roll of paper, said paper tensioning member having a lifting portion accessible by a finger of the hand while a grip is being maintained for allowing a user to dispose said paper tensioning member in said second orientation;

improvements therein comprising:

a detent affixed to said frame, said paper tensioning member disengaged from said detent in said first orientation and detachably engaged with said detent in said second orientation to hold said paper tensioning member in said second orientation.

2. The hand held masking machine of claim 1, wherein said paper tensioning member includes a tab to detachably engage said detent in said second orientation.

* * * * *